United States Patent [19]

Quan et al.

[11] 4,084,661

[45] Apr. 18, 1978

[54] ELEVATOR SYSTEM

[75] Inventors: Wing C. Quan, Waldwick, N.J.; David M. Edison, Murrysville, Pa.; George T. Hummert, Oakmont, Pa.; Milton Sackin, Pittsburgh, Pa.

[73] Assignee: Westinghouse Electric Corporation, Pittsburgh, Pa.

[21] Appl. No.: 467,700

[22] Filed: May 7, 1974

[51] Int. Cl.[2] ..... B66B 1/20

[52] U.S. Cl. ..... 187/29 R

[58] Field of Search ..... 187/29

[56] References Cited

U.S. PATENT DOCUMENTS

| | | | |
|---|---|---|---|
| 3,385,402 | 5/1968 | Burgy et al. | 187/29 |
| 3,642,099 | 2/1972 | Yuminaka et al. | 187/29 |
| 3,648,805 | 3/1972 | Suozzo et al. | 187/29 |

*Primary Examiner*—Robert K. Schaefer
*Assistant Examiner*—W. E. Duncanson, Jr.
*Attorney, Agent, or Firm*—D. R. Lackey

[57] ABSTRACT

An elevator system, and method of operating same, including a plurality of elevator cars mounted in a building to serve the floors therein. A system processor, having instructions stored in a memory, responds to predetermined system information to provide output signals for controlling the movement of the elevator cars. Predetermined lobby functions, such as quota control of elevator cars at the floor and dispatching therefrom, are provided by the instructions for a floor identified in the instructions. The floor for which such lobby functions are performed is changed in response to predetermined conditions, to any selected floor of the building, by means which changes the number of the identified floor in the associated instructions.

20 Claims, 13 Drawing Figures

ELEVATOR SYSTEM

BACKGROUND OF THE INVENTION

1. Field of the Invention:

The invention relates in general to elevator systems, and more specifically to strategy for controlling the operation of a plurality of elevator cars in an elevator system.

2. Description of the Prior Art:

The lower terminal, main floor, or lobby, as it is variously called, requires substantially more wiring and controls than other floors of the building in elevator systems of the prior art. This is due to the main floor demand or quota control, and dispatching functions, usually associated with this floor. For example, dispatching requires the detection of cars at the main floor, the selection of a next car, control of hall lanterns and doors in response thereto, weight of the load in cars at the lobby floor, car calls in the cars located at the lobby floor, and other events which may determine the dispatching of the Next car. The main floor demand function involves car detectors and car counters for counting cars at the main floor and controls to call cars to the main floor to establish and maintain a desired quota.

Elevator systems may have traffic patterns at certain times of the day which make it advantageous to provide quota and dispatching functions at a floor other than the main or lobby floor. For example, garage levels below the main floor may have heavier traffic at certain times of the morning than the lobby floor; a convention floor may have concentrated heavy traffic at any time of the day or night; and, depopulating a building by staggered quitting times may switch heavy traffic from one floor to another on a timed basis. Since the quota and dispatching functions require costly control, any attempt in the prior art to provide such functions is on a very selective and usually partial basis, such as a complicated mixture of two partial lobbies in response to the setting of a switch, which requires additional costly control at the "extra" lobby; and, by a special convention floor feature which requires spotting controls or other costly sensing and quota controls which are required at the convention floor.

It would be desirable to be able to automatically and completely switch the lobby functions, or at least certain of the lobby functions, from one floor to any other floor in the building, and to select the dispatching direction from this floor, due to anticipated or actual traffic demands at a floor, making the normal lobby the same as any other non-lobby floor during the time the lobby functions are switched to another floor, if this could be accomplished without adding additional costly control at each floor of the building.

SUMMARY OF THE INVENTION

Briefly, the present invention is a new and improved elevator system, and method of operating same, in which all floors of the structure are wired as non-lobby floors, with the system having the capability of selecting the floor for which the lobby functions are to be provided, and for changing the selection automatically in response to anticipated or actual traffic demand. The lobby floor selection may also be manually made to a predetermined floor, such as for riot control when it is desired to prevent entry into the upper floors of the building from the lobby via the elevator cars. In the instance of manual switching for riot control, the lobby is switched to a selected floor above the lobby and the elevator cars are automatically inhibited from serving the lobby and any other selected floors, such as all floors below the riot control floor.

The elevator system includes a plurality of elevator cars mounted for movement in a building to serve the floors therein, means for providing car status signals, means for registering requests for elevator service, and a programmable system processor for providing signals for controlling the movement of the elevator cars, responsive to the car status signals and requests for elevator service.

The system processor includes a memory having instructions stored therein, which instructions provide predetermined lobby functions, such as quota and dispatching control, for a floor identified in the instructions. The direction of dispatching is also specified in the instructions. Thus, the lobby functions may be associated with any selected floor of the building, by changing the instruction which identifies the lobby floor.

The instruction identifying the lobby floor may be changed manually, such as by a riot control switch which, when operated to a predetermined condition, automatically selects a predetermined floor as the lobby; it may be changed to a predetermined floor in the anticipation of a demand at that floor, such as by a manually operated switch, or a clock operated switch; and/or it may automatically be changed to any floor of the structure, with dispatching in the up or down direction from the selected floor, in response to detected traffic "events" in the system which indicate the desirability of switching the lobby functions to this floor.

BRIEF DESCRIPTION OF THE DRAWING

The invention may be better understood, and further advantages and uses thereof more readily apparent, when considered in view of the following detailed description of exemplary embodiments, taken with the accompanying drawings, in which:

FIG. 5 is a diagrammatic representation of a record established for each floor of the building, for each service direction, to indicate when the lobby floor functions should be changed, and to which floor they should be changed to;

DESCRIPTION OF THE PREFERRED EMBODIMENTS

FIG. 1

Figure 1:
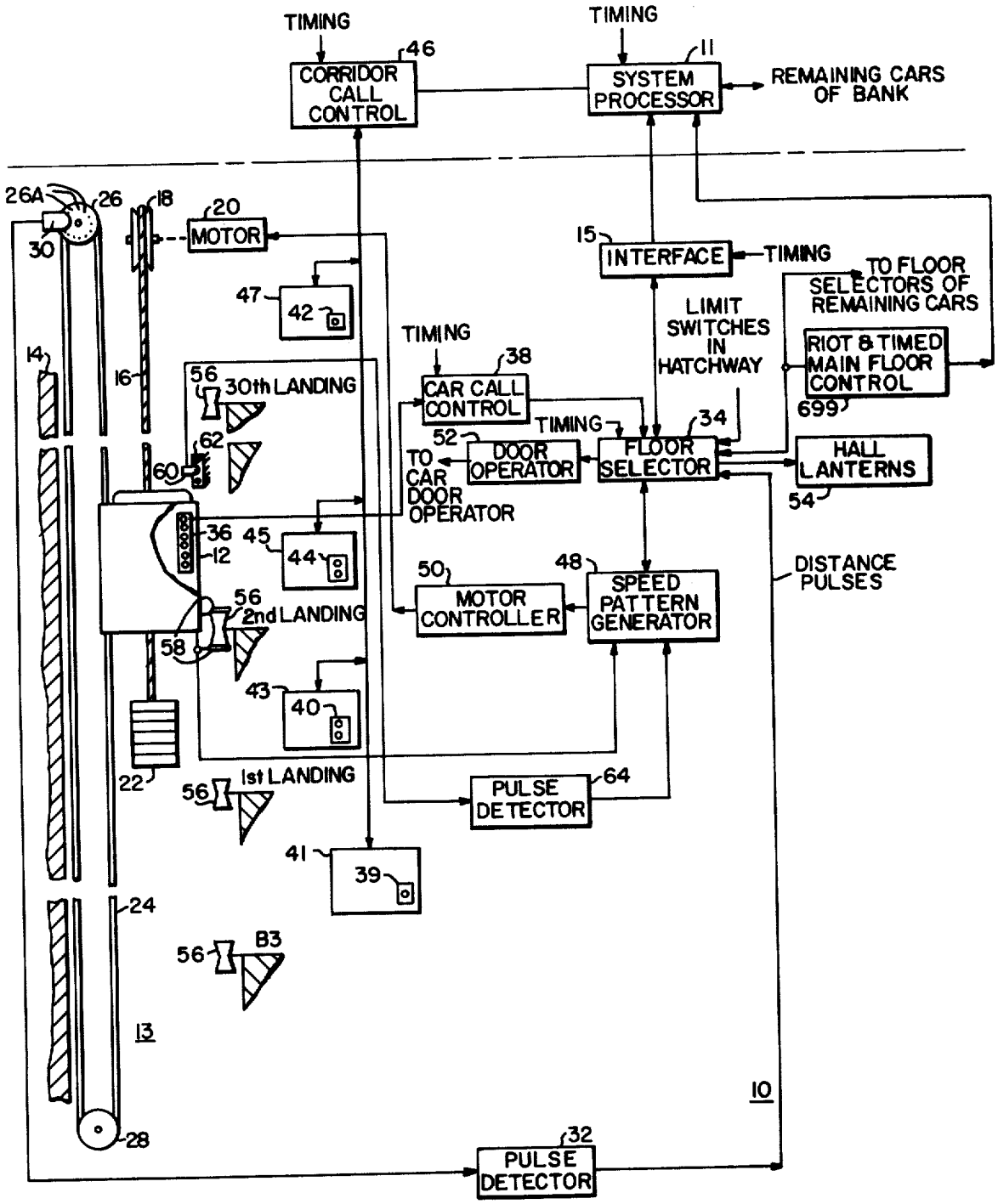
FIG. 1 is a partially schematic and partially block diagram of an elevator system constructed according to the teachings of the invention.

Referring now to the drawings, and FIG. 1 in particular, there is shown an elevator system 10 which may utilize the teachings of the invention. Elevator system 10 includes a plurality of elevators cars, such as car 12, the movement of which is controlled by a system processor 11. System processor 11 is of the programmable type which includes a core memory having a software package, ie., instructions, stored therein, and a processor for executing the stored instructions to direct the elevator cars to efficiently serve requests for elevator service. The processor prepares and transmits signals to the elevator cars to direct them to serve the requests for elevator service according to the specific strategy defined by the instructions. In order to limit the length and complexity of the present application, a complete elevator system having a system processor of the type which may utilize the teachings of the invention is disclosed in U.S. Pat. No. 3,750,850 entitled "Floor Selector for an Elevator Car" which issued Aug. 7, 1973 in the names of C. L. Winkler and A. Wavre, copending application Ser. No. 340,618 entitled "Elevator System", which was filed Mar. 12, 1973 in the name of D. Edison, now U.S. Pat. 3,804,209 and copending application Ser. No. 340,615 entitled "Elevator System", which was filed Mar. 12, 1973 in the name of M. Sackin, now U.S. Pat. No. 3,851,734 are assigned to the same assignee as the present application. The Winkler et al U.S. Patent, Edison and Sackin patents are hereby incorporated into the present application by reference. Only the portions of the aforesaid patents necessary to understand the present invention will be disclosed and described in the present application. Also, since each of the cars of the bank of cars and the controls therefor, are similar in construction and operation, only the controls for car 12 are shown in FIG. 1.

More specifically, elevator car 12 is mounted in a hatchway 13 for movement relative to a structure 14 having a plurality of landings, such as 33, including three basement or garage levels, B3, B2 and B1, and 30 additional floors. Only the lowest basement level B3, and the first, second and the thirtieth landings are shown in FIG. 1, in order to simplify the drawing. The car 12 is supported by a rope 16 which is reeved over a traction sheave 18 mounted on the shaft of a drive motor 20, such as a direct current motor as used in the Ward-Leonard drive system, or in a solid state drive system. A counterweight 22 is connected to the other end of the rope 16. A governor rope 24 which is connected to the top and bottom of the car is reeved over a governor sheave 26 located above the highest point of travel of the car in the hatchway 13, and over a pulley 28 located at the bottom of the hatchway. A pick-up 30 is disposed to detect movement of the car through the effect of circumferentially spaced openings 26A in the governor sheave 26. The openings in the governor sheave are spaced to provide a pulse for each standard increment of travel of the car, such as a pulse for each .5 inch of car travel. Pick-up 30 provides pulses in response to the movement of the openings 26A in the governor sheave. Pick-up 30 is connected to a pulse detector 32 which provides distance pulses for a floor selector 34.

Car calls, as registered by pushbutton array 36 mounted in the car 12, are recorded and serialized in car call control 38, and the resulting serialized car call information is directed to the floor selector 34.

Corridor calls, as registered by pushbuttons mounted in the corridors, such as the up pushbutton 39 located at the lowest level B3, and the down pushbutton 42 located at the thirtieth landing, and the up and down pushbuttons 40 and 44 located at the first, second and other intermediate landings, are recorded and serialized in corridor call control 46. The resulting serialized corridor call information is directed to the system processor 11. The system processor 11 directs the corridor calls to the cars through an interface circuit, shown generally at 15, to effect efficient service for the various floors of the building and effective use of the elevator cars. The wiring and control specifically associated with each floor is illustrated at 41, 43, 45 and 47 for levels or floors B3, 1, 2, and 30, respectively, which controls, other than the fact that the lowest and highest floors have controls for only one service direction, are substantially the same for all floors.

The floor selector 34 processes the distance pulses from pulse detector 32 to develop information concerning the position of the car 12 in the hatchway 13, and also directs these processed distance pulses to a speed pattern generator 48 which generates a speed reference signal for a motor controller 50, which in turn provides the drive voltage for motor 20.

The floor selector 34 keeps track of the car 12 and the calls for service for the car, it provides the request to accelerate signal to the speed pattern generator 48, and provides the deceleration signal for the speed pattern generator 48 at the precise time required for the car to decelerate according to a predetermined deceleration pattern and stop at a predetermined floor for which a call for service has been registered. The floor selector 34 also provides signals for controlling such auxiliary devices as the door operator 52, the hall laterns 54, and it controls the resetting of the car call and corridor call controls when a car or corridor call has been serviced.

Landing, and leveling of the car at the landing, is accomplished by a hatch transducer which utilizes inductor plates 56 disposed at each landing, and a transformer 58 disposed on the car 12.

The motor controller 50 includes a speed regulator responsive to the reference pattern provided by the speed pattern generator 48. The speed control may be derived from a comparison of the actual speed of the motor and that called for by the reference pattern by using a drag magnet regulator, such as disclosed in U.S. Pat. Nos. 2,874,806 and 3,207,265, which are assigned to the same assignee as the present application.

An overspeed condition near either the upper or lower terminal is detected by the combination of a pick-up 60 and slow-down blades, such as a slow-down blade 62, which generates pulses in the pick-up 60 when there is relative motion between them. These pulses are processed in pulse detector 64 and directed to the speed pattern generator 48 where they are used to detect overspeed.

A new and improved floor selector 34 for operating a single elevator car, without regard to operation of the car in a bank of car, has been disclosed in the incorporated Winkler et al U.S. patent.

The programmable system processor 11 includes an interface function for receiving signals from, and sending signals to, the car controllers (interface 15) of the elevator cars in the elevator system, a core memory in which a software package is stored, a processor for executing instructions stored in the memory relative to the dispatching of elevator cars and otherwise controlling a group of elevator cars according to software strategy stored in the core memory, and a timing function for controlling the transmission of data between the system processor 11 and the car controllers of the elevator cars.

The incorporated Edison patent discloses a new and improved elevator system for operating a plurality of elevator cars according to a software program stored in the core memory of the system processor 11. The incorporated Sackin patent discloses a programmable processor 11 for executing the instructions stored in the core memory, as well as strategy for dispatching a plurality of elevator cars to more efficiently service calls for elevator service registered from the various landings or floors of an associated structure. The strategy is implemented by software, which acts upon the data received from the corridor call registers and from the car controllers of the various elevator cars, to provide signals for the car controllers which effect the strategy of the stored program.

As hereinbefore described, certain functions such as quota control relative to the number of elevator cars maintained at a floor under certain conditions, and dispatching cars from a floor, are usually associated with only the main or lower lobby floor, or with two floors at most, because of the additional control required for each floor for which quota and dispatching functions are required. The present application discloses a new and improved elevator system in which the control specific to each floor, such as controls 41, 43, 45 and 47, are all similar, at least in their lack of wired control for providing the aforesaid lobby functions.

In the present invention, the floor for which the normal lobby functions are performed is identified in the instructions stored in the core memory of the system processor 11, and the floor which is identified as the lobby floor, as well as the dispatching direction from the floor, are controllable. Since the lobby floor is identified only by a number in the stored instructions, it may be switched to any floor of the structure by changing the number. No hardware additions or changes are required to designate a specific floor as the lobby floor. The invention covers switching the lobby floor from the "normal" lobby floor to a selected floor by a manually operated switch, by a time controlled switch, and/or by detecting traffic conditions which indicate the desirability of assembling a quota of cars at any floor of the building, and dispatching the elevator cars therefrom. The traffic event, or events, which indicate a desirability to switch the lobby functions to some other floor may be indicated by an interrupt or other signal from hardware; the traffic event may be detected by the software, such as by comparing successive car status data inputs received by the system processor as signal words from the various elevator cars; the traffic event may be detected by timing corridor and floor calls from registration; or by any combination of these arrangements for detecting traffic conditions may be used.

FIG. 1 illustrates riot and timed main floor control 699 which provides hardware generated signals indicating that the lobby functions should be changed from whatever floor they are currently associated with to some predetermined floor. The riot main floor control is responsive to a manually operated switch. When the riot control switch is operated from a first to a second condition, the lobby functions are transferred to a predetermined floor, usually to a floor located above the normal lobby floor, and all of the elevator cars are inhibited from serving at least the floor which is at street level, and usually all of the floors located below the newly selected riot control main floor. The timed main floor portion of control 699 is responsive to timer controlled contacts, with the timer being synchronized to operate the contacts to a predetermined condition during a predetermined time period, during which peak traffic conditions are anticipated at the specified floor, based on the history of traffic in the building.

Figure 2:
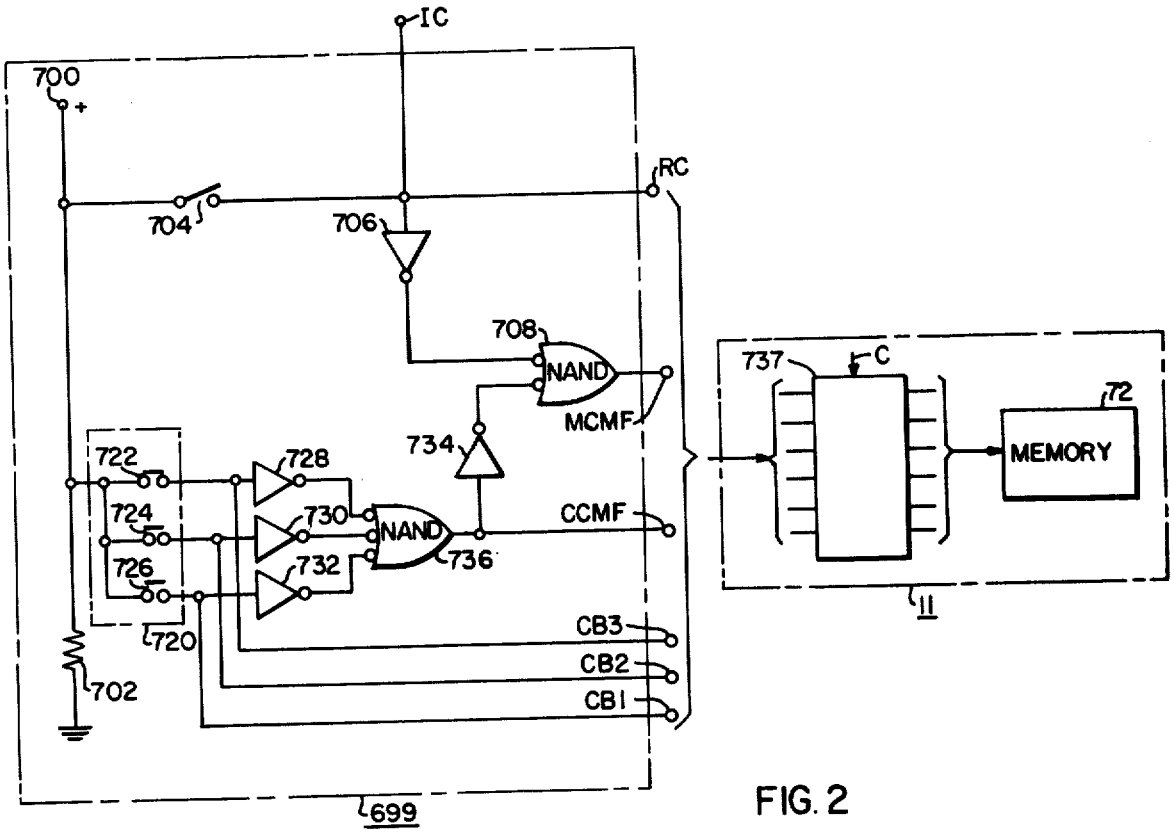
FIG. 2 is a schematic diagram of riot and timed main floor control which may be used for these functions shown in block form in FIG. 1.
Figure 3:
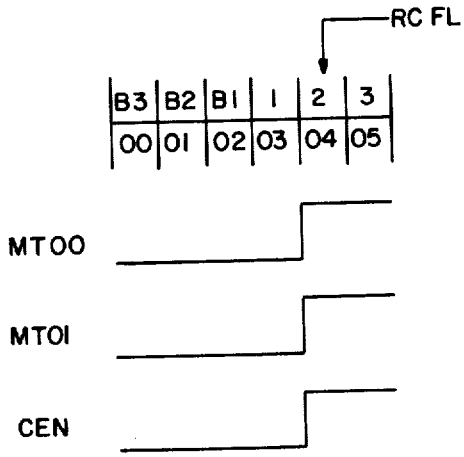
FIG. 3 is a graph which illustrates the inhibiting of floor and car calls for floors below the riot control floor.

FIGS. 2 and 3

FIG. 2 is a schematic diagram of riot and timed main floor control 699 which may be used for these functions shown in block form and referenced 699 in FIG. 1. The riot control portion of control 699 includes a source of electrical potential, indicated generally by terminal 700, connected to ground via a resistor 702, a switch 704, an inverter 706, a dual input NAND gate 708, and output terminals IC, RC and MCMF. Switch 704 has one side thereof connected to source potential 700, and its other side is connected to output terminals IC and RC, and to the input of inverter 706. The output of inverter 706 is connected to an input of NAND gate 708, and the output of NAND gate 708 is connected to output terminal MCMF. When switch 704 is open, output terminals IC and RC are low, or at the logic zero level, and the output of inverter 706 is high, or at the logic ONE level. The output of NAND gate 708 is controlled by the logic level of its other input. When switch 704 is closed, to place the lobby floor location under riot control, output terminals IC and RC provide true or logic one signals, while the inverter 706 applies a logic zero signal to NAND gate 708 which forces output terminal MCMF to the logic one level.

Output terminal IC is connected to the floor selector 34, such as to the memory 90 thereof as illustrated in the incorporated Winkler et al U.S. Patent. Memory 90 is a read only memory programmed such than when signal IC is true signals MT00, MT01 and CEN block all of the cars from accepting up and down floor calls, and car calls, respectively, from and for predetermined floors, such as the floors located below the new lobby floor. For example, as shown in the graph of FIG. 3, if the associated building has three levels below the normal main floor, such as levels B3, B2 and B1, a normal main floor 1, and the riot control floor is selected to be the second floor, the read only memory may be programmed such that signals MT00, MT01 and CEN are at the logic zero level for the time slots associated with levels B3, B2, B1 and 1. Thus, the floor and car calls appearing in these time slots will be blocked from appearing in the call selector process by the gates which are normally enabled by signals MT00, MT01 and CEN.

Signal RC is sent to the system processor 11, such as to a register 737 where it is stored until it is clocked into the core memory 72. When signal RC goes true with the closing of switch 704, the system processor 11 changes the lobby functions from the floor they are presently associated with to a predetermined floor, such as to the second floor.

Signal MCMF is a master flag signal which is also sent to the system processor 11. Signal MCMF is true when one of several different functions request that the lobby floor functions be transferred to another floor.

The time controlled lobby floor portion of control 699 includes a clock or timer 720, which for purposes of example, includes three contacts 722, 724 and 726, four inverters 728, 730, 732 and 734, and three input NAND gate 736, and output terminals CCMF, CB3, CB2 and CB1. One side of each of the timer controlled contacts 722, 724 and 726 is connected to terminal 700, which represents the source of electrical potential. The other side of contact 722 is connected to an input of NAND gate 736 via inverter 728, and directly to output terminal CB3. The other side of contact 724 is connected to an input of NAND gate 736 via inverter 730, and directly to output terminal CB2. The other side of contact 726 is connected to an input of NAND gate 736 via inverter 732, and directly to output terminal CB1. The output of NAND gate 736 is connected to output terminal CCMF, and to an input of NAND gate 708 via inverter 734.

When all of the contacts of timer 720 are open, output terminals CB3, CB2 and CB1 are all at the logic zero level, the output of NAND gate 136 is at the logic zero level, as is the output terminal CCMF, and the input to NAND gate 708 is a logic one. Thus, NAND gate 708 provides a logic zero output at terminal MCMF if switch 704 is open.

It will be assumed that the three floor levels B3, B2 and B1 located below the normal main floor are garage levels which fill sequentially in the recited order at predetermined times during each work day, and the lobby functions are to be transferred to these three floors in a timed sequence synchronized with this anticipated demand. At the time the lobby functions are to be transferred to level B3, contact 722 will close and signal CB3 will go the logic one level. Output terminal CB3 is connected to the system processor 11 and signal CB3, when true, identifies the specific floor to which the lobby functions are to be transferred. The high input to inverter 728 from the closed contact 722 switches the output of NAND gate 736 to the logic one level. Output terminal CCMF thus goes to a logic ONE level, and this signal is also sent to the system processor 11. Signal CCMF, when true, notifies the system processor 11 that some clock related contact is closed. The high output of NAND gate 736 is inverted by inverter 734 and NAND gate 708 provides a logic one signal to output terminal MCMF. The true MCMF signal notifies the system processor 11 that some function has requested a lobby floor change.

In like manner, timer controlled contact 724, when closed, provides true signals at output terminals CB2, CCMF and MCMF; and, contact 726, when closed, provides true signals at output terminals CB1, CCMF and MCMF. The specific use of the hardware signals from control 699 in the system processor 11 will be hereinafter explained.

Before describing the specific software changes and additions required based upon the incorporated Sackin patent, certain tables kept by the software, or referred to by the software, in addition to those described in the aforesaid Sackin patent, will be described.

FIG. 4

Figure 4:
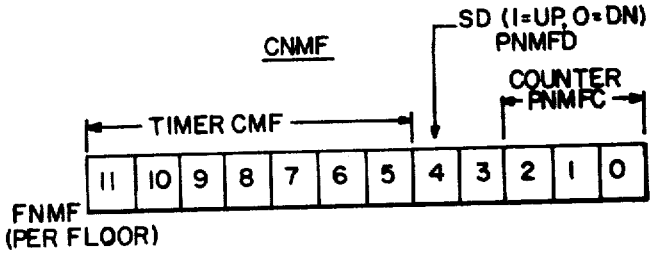
FIG. 4 is a diagrammatic representation of a word established by the system processor for each floor of the building to record certain traffic conditions which might occur at these floors.

FIG. 4 illustrates one word PNMF of a table CNMF kept by the software, with each landing of the structure having a 12 bit word similar to the word PNMF. The word PNMF includes a 3-bit counter PNMFC which counts predetermined events to be described later which happen relative to the associated floor, a 7-bit timer CMF which times certain predetermined events associated with the floor of the word, and one of the remaining bits of the word, such as bit 4, indicates the service direction associated with a predetermined event. This bit is referred to as bit PNMFD. A "one" indicates the up service direction, and a "zero" indicates the down service direction. The start of the table CNMF has a predetermined address in the core memory, and thus the address for locating the word for a specific floor is easily determined, both for storing information into the word and for detecting the information stored therein, as required.

FIG. 5

Figure 5:
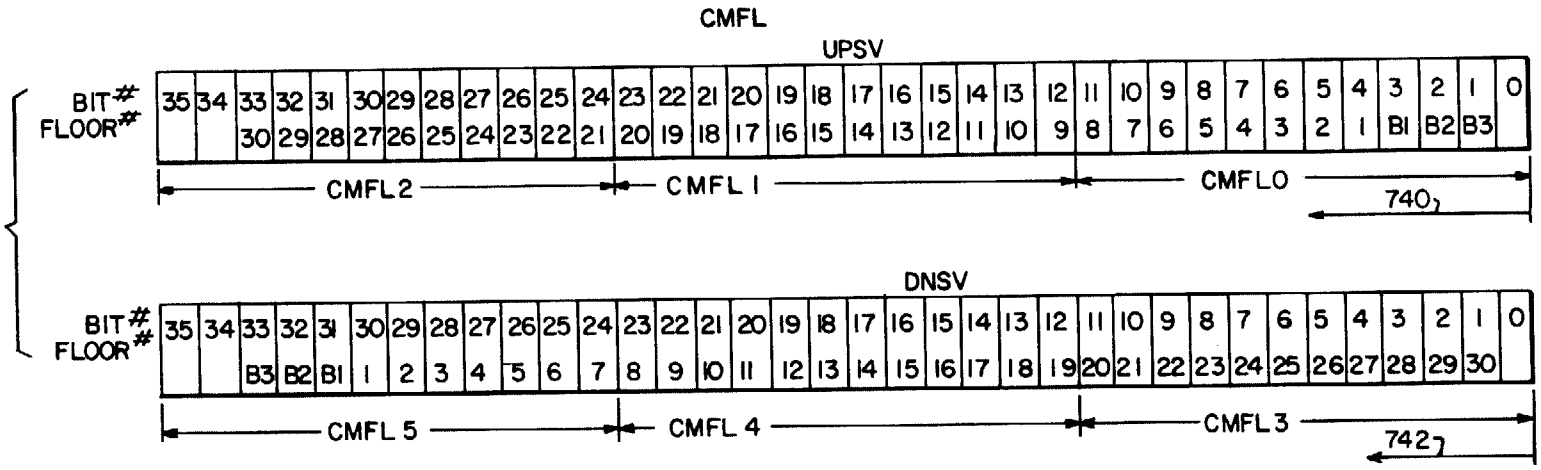

FIG. 5 illustrates a record CMFL the start of which is located at a predetermined memory address, which record is used to store an indication that the lobby function should be changed to accommodate a predetermined actual traffic demand at a specific floor, and the service direction from the floor in which cars are to be dispatched. Record CMFL includes six-12 bit words CMFL0 through CMFL5, which accommodate up to 36 floors. If the building has more than 36 floors, the record may be changed as required to accomodate the additional floors. Words CMFL0, CMFL1 and CMFL2 utilize 36 locations labeled 0 through 35, with the different floor levels each associated with a different location or bit. For example, the lower level B3 may be associated with bit 1, in which event the top level, i.e., level 30 in the example, would be associated with bit 33. When the lobby functions should be transferred to a floor based upon a demand from a floor in the up direction (UPSV), a bit is set in one of the three words CMFL0-CMFL2 corresponding to the specific floor.

Words CMFL3, CMFL4 and CMFL5 utilize 36 bits, or locations labeled 0 through 35, with the different floor levels each associated with a different bit. It will be noted in FIG. 5 that the lowest level starts in the word CMFL5, at the left hand side of the 3 word record, instead in the word which starts at the right hand side of the record, as in the first three words. When the lobby functions should be transferred to a floor based upon a demand from a floor in the down direction (DNSV), a bit is set in one of the three words CMFL3-CMFL5 corresponding to the specific floor.

When the instructions search for a bit set in table CMFL, the first three words CMF10-CMFL2 are scanned starting at bit zero, in the direction indicated by arrow 740. The last three words CMFL3-CMFL5 are then scanned starting with bit zero, in the direction indicated by arrow 742. The first set bit found using the above mentioned scanning arrangement is the one used by the software. If more than one bit is set, the above described arrangement gives priority to the lowest floor in which an up dispatching direction is required. If the normal main or lobby floor is level 1, it will have priority over all floors except levels B3, B2 and B1, when it is to be set for dispatching in the up direction.

If there are no bits set in the first three words, indicating there is no demand present of sufficient magnitude to request a lobby floor change based upon traffic desiring to travel in the upward direction, the floors are again checked, starting with the highest floor, to determine if a lobby floor change has been requested for service in the down direction. The highest floor in the building for which a bit is set will receive priority for dispatching in the down direction.

FIG. 6

Figure 6:
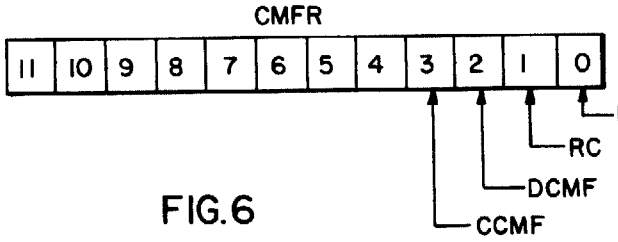
FIG. 6 is a diagrammatic representation of a register maintained to determine when the lobby functions should be changed to another floor, and to determine the event which indicated a change is desirable.

FIG. 6 is a register CMFR referred to by the software to determine if a lobby floor change has been requested, and if so, which of the several functions set up to request such a change actually initiated the request. The register CMFR is also a priority register, in that the bits are checked in a predetermined order starting from bit zero. The master flag signal MCMF sets bit zero, when it is generated, by either the hardware, such as in FIG. 2, or by the software. When the software is in the portion of the program for checking to determine if there has been a request to change lobby floors, bit zero of word CMFR is checked. If it is a logic zero, the portion of the program relating to a change of lobby floor is omitted. If it is a logic 1, the program relating to change of lobby floor is utilized.

A lobby change request by the riot control signal RC sets bit 1 of register CMFR. If this bit is set, it receives the highest priority, as when bit 0 has been found to be set, bit 1 is then checked to see if it is set.

Bit 2 is set by a signal DCMF developed in the software when traffic events indicate the lobby floor should be changed.

Bit 3 is set by the signal CCMF from control 699 shown in FIG. 2, when a request to change lobby floor is made by the clock or timer 720. Thus, a demand to change lobby floors based on actual traffic has priority over a demand based on anticipated traffic. For example, a demand for up dispatching from the normal lobby floor sufficient to make this the actual lobby floor will maintain the lobby functions at the normal lobby floor notwithstanding a clock request to change the lobby functions to a different floor.

In describing the detailed programmer flow charts set forth in certain of the remaining figures, it will be helpful to set forth the program identifiers, signals and symbols used in these flow charts, which have not been used in the incorporated Sackin patent.

| Symbol | Description |
|---|---|
| CB1 | a signal which is true when the lobby functions are requested to be transferred to floor B1 |
| CB2 | a signal which is true when the lobby functions are requsted to be transferred to floor B2 |
| CB3 | a signal which is true when the lobby functions are requested to be transferred to floor B3 |
| CCMF | a signal (flag) which, when true, indicates there has been a request to change the lobby functions to another floor based upon a clock |
| CMF | a timer in word PNMF |
| CMFL | a table indicating when a service demand is sufficient to request the lobby functions to be changed, and the floor and service direction |
| CMFLO-CMFL5 | word names in table CMFL |
| CMFR | a flag and priority register for changing lobby functions to another floor |
| CNMF CNMF | a record for storing certain information relative to each floor |
| DCMF | a signal (flag) which, when true, requests a traffic responsive change of lobby functions to another floor |
| IC | a signal which, when true, inhibits cars from traveling to predetermined floors |
| LTX | the floors (zone) above the lobby floor when the dispatching direction is down |
| MCMF | a signal (flag) which, when true, indicates that some function has requested that the lobby functions should be changed to another floor |
| MFL | the floor presently recognized by the software as the main or lobby floor |
| MMFL | the main or lobby floor number preceeded by a minus sign |
| $\overline{PCR}$ | a signal which is true for a short period of time when the advance car position changes floors |
| PNMF | a per floor word in record CNMF |
| PNMFC | a counter in word PNMF |
| PNMFD | service direction bit of word PNMF |
| RC | a signal which, when true, requests that the lobby functions be changed to a riot control floor |
| TMFL | a subroutine for selecting a new main or lobby floor |
| $\overline{WTCH}$ | a signal which is true when a car arrived at a floor less than 50% loaded and was loaded to at least 75% of its capacity at the floor |
| WT50 | a signal which is true when the load in the car exceeds 50% of capacity |
| WT75 | a signal which is true when the load in the car exceeds 75% of its capacity |
| Z1 | a variable |
| 32L | a signal which is true when the elevator car is moving |

Figure 8:
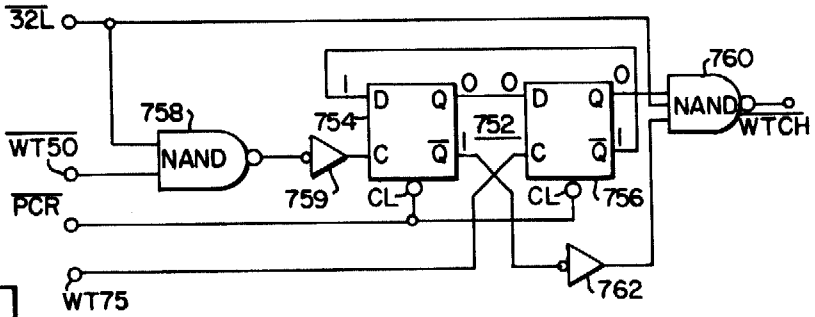
FIG. 8 is a schematic diagram of a circuit which may be used to indicate the occurrence of a traffic event monitored for purposes of determining when the lobby functions should be changed from one floor to another floor.
Figure 9:
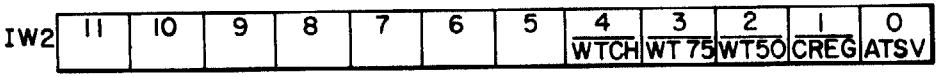
FIG. 9 is a diagrammatic representation of input word IW2 which is sent from each car controller to the system processor.
Figure 7:
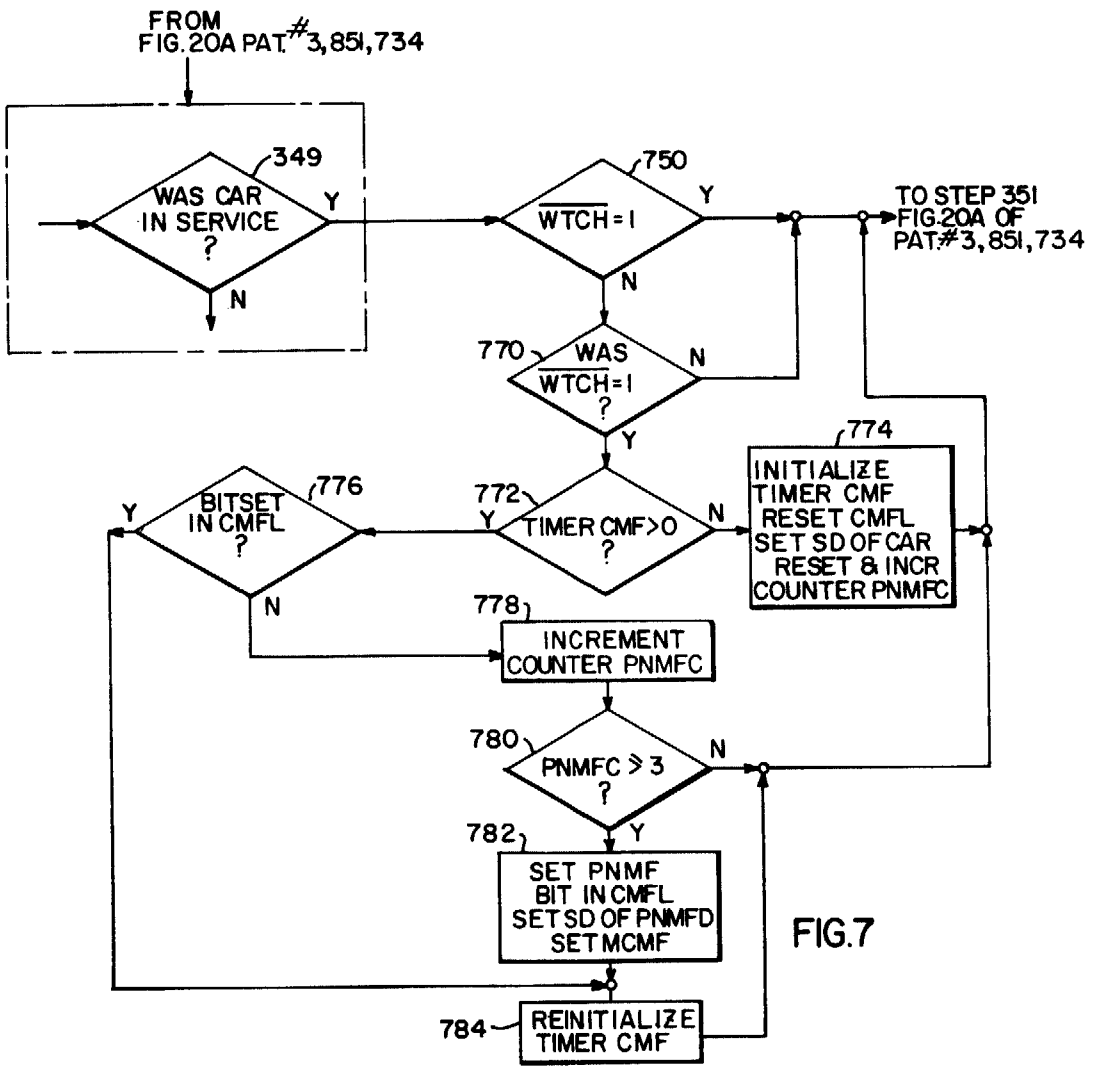
FIG. 7 is a flow chart illustrating the detection of a traffic event which may be used to change the lobby floor functions to any other floor of the building.

FIGS. 7, 8 and 9

FIG. 7 is a flow chart which is added between steps 349 and 351 of FIG. 20A of the incorporated Sackin patent. FIG. 20A is part of the car status update program CSU, in which the status of each elevator car is determined. The purpose of this modification of FIG. 20A of the aforesaid Sackin patent is to determine if the elevator traffic relative to any one floor is sufficient to request that certain lobby functions be transferred to that floor. For purposes of example, the load in the elevator car is used to make this determination, but any suitable traffic indicator may be used.

More specifically after step 349 of FIG. 20A of the incorporated Sackin patent determines that the elevator car is in service, step 750 determines if the load in the elevator car has changed from less than 50% of its capacity to more than 75% of its capacity while the elevator car was standing at a floor. This may be determined by the software by comparing successive data records, and observing if the hardware signals WT50 and WT75 both change from logic zero to logic one while the car is standing at a floor. Signals WT50 and WT75 go from logic zero to logic one when the car weight exceeds 50% and 75% of capacity, respectively, and they are included in input word IW2 at bit locations 2 and 3, respectively. FIG. 9 reproduces word IW2, which word is sent from each car controller to system processor 11.

This indication may also be conveniently developed by hardware, such as by the circuit illustrated in FIG. 8. The circuit of FIG. 8 includes a counter 752, which may include first and second D-type edge triggered flip flops 754 and 756, respectively, such as Texas Instrument's SN7474. Signal $\overline{WT50}$ is connected to the clock input C of flip flop 754 via a dual input NAND gate 758 and an inverter 759. Signal WT75 is connected to the clock input C of flip flop 756. Signal $\overline{PCR}$ is connected to the CLEAR inputs of both flip flops 754 and 756. Signal $\overline{32L}$ is connected to the remaining input of NAND gate 758. The Q output of flip flop 754 is connected to the D input of flip flop 756, and the $\overline{Q}$ output of 756 is connected to the D input of flip flop 754. The $\overline{Q}$ output of flip-flop 754 is connected to an input of a three input NAND gate 760 via an inverter 762. The Q output of flip flop 756 is connected to another input of NAND gate 760. The third input of NAND gate 760 is connected to input terminal $\overline{32L}$. The output of NAND gate 760 is connected to an output terminal $\overline{WTCH}$. The signal appearing at output terminal $\overline{WTCH}$ is sent from each car to the system processor 11 in bit location 4 of input word IW2, as illustrated in FIG. 9.

Signal $\overline{PCR}$ goes low for a short period of time each time the advanced car position of the elevator car changes floors, which low signal starts the counter 752 with the logic level signals indicated in FIG. 8, as the car stops at a floor. When the car stops, the signal $\overline{32L}$ goes high to enable NAND gates 758 and 760. When the car is moving signal $\overline{32L}$ is low and NAND gate 760 is blocked, providing a high output to terminal $\overline{WTCH}$.

If the car load is less than 50% of capacity when the elevator car stops at a floor, signals $\overline{WT50}$ and $\overline{32L}$ will both be high, the output of NAND gate 758 will be low, and the low output is inverted to a high signal which clocks flip flop 754, transferring the logic one level signal at the D-input thereof to its Q output. The $\overline{Q}$ output is now at the zero logic level, which is inverted by inverter 762 to the logic one level. NAND gate 760 thus has two ones and a zero input, which results from the car stopping at any floor with less than 50% load.

Now if the car load should exceed 75% while the car is at this floor, signal WT75 will go high, clocking flip flop 756 and transferring the logic one signal at its D input to its Q output, which switches the output of NAND gate 760 to provide a low or true signal at output terminal $\overline{WTCH}$.

If the car arrives at floor with over 50% load, signal $\overline{WT50}$ will be a low and flip flop 754 will not be clocked. If the car unloads below the 50% level while the car is at this floor, signal $\overline{WT50}$ will go high and flip flop 754 will be clocked. If the car should now reload to the 75% level while at this floor, flip flop 756 will be clocked and signal $\overline{WTCH}$ will go true.

Returning to FIG. 7, step 750 determines if the car load changed from less than 50% of capacity to more than 75% of capacity while at a specific floor by checking bit 4 of input word IW2. If bit 4 is a logic one, the program advances to step 351 of FIG. 20A of the incorporated Sackin patent. If signal $\overline{WTCH}$ is not at the logic one level, step 770 determines if we have already noted that signal $\overline{WTCH}$ was not a one on a previous run through the program. Since the run through the complete program takes less than 1 second, the program will run many times while a car is located at a floor, and it is only necessary to note the first time that signal $\overline{WTCH}$ goes true. If signal $\overline{WTCH}$ was true on a previous run through the program, the program advances to step 351. If signal $\overline{WTCH}$ was a logic one on the last run through the program, step 772 checks timer CMF in the word PNMF associated with the floor at which the car is located (table CNMF - FIG. 4). If the timer CMF is not already timing, step 774 initializes timer CMF in word PNMF for the specific floor in question, such as by incrementing the timer to a predetermined value. Bit 4 of a word PNMF is set to indicate the service direction (PNMFD) of the car. Counter PNMFC of word PNMF is reset and incremented by one. The associated bit in record CMFL is reset to zero, in the event that it had been previously set to the one level and the timer CMF had timed down to zero. The program then advances to step 351.

If timer CMF had been previously initialized and it is still in the process of timing towards zero, this indicates that another car was previously loaded at this floor, within the time period of the timer CMF and step 776 checks table CMFL to see if a bit has been set for the service direction of the car. Since it is unlikely that cars would be loaded at a predetermined floor for both service directions within the predetermined time period of timer CMF, there is only one word PNMF per floor. However, two words per floor may be used if desired, one for each service direction.

If there is no bit set in CMFL for this floor in the service direction of the car, step 778 increments counter PNMFC in word PNMF for the specific floor and step 780 checks the magnitude of the count in this counter. If a predetermined number of cars have been loaded at this floor within the time period of timer CMF, such as three, for example, and three is the number required to set a bit in CMFL, step 782 sets the bit in CMFL for the floor associated with the word PNMF in question, for the service direction PNMFD (bit 4 of word PNMF). The master flag MCMF, i.e., bit 0 of register CMFR (FIG. 6) is also set. Step 784 reinitializes the timer once a bit is set for the floor, and each car loaded at this floor within this predetermined period of time will reinitialize the timer CMF. This is accomplished when step 776 finds a bit already set in CMFL by advancing from step 776 to step 784 to reinitialize the timer. Step 784 then advances to step 351. Thus, in the arrangement of example shown in FIG. 7 a predetermined threshold of traffic at a floor sets the bit which indicates the lobby function should be changed to this floor, and then a lower level of traffic at the floor will reinitialize timer CMF to maintain the bit set for the floor. It would also be suitable to require that the traffic level remain at the same level which set the bit initially, in order to maintain the bit set for the floor.

FIG. 10

Figure 10:
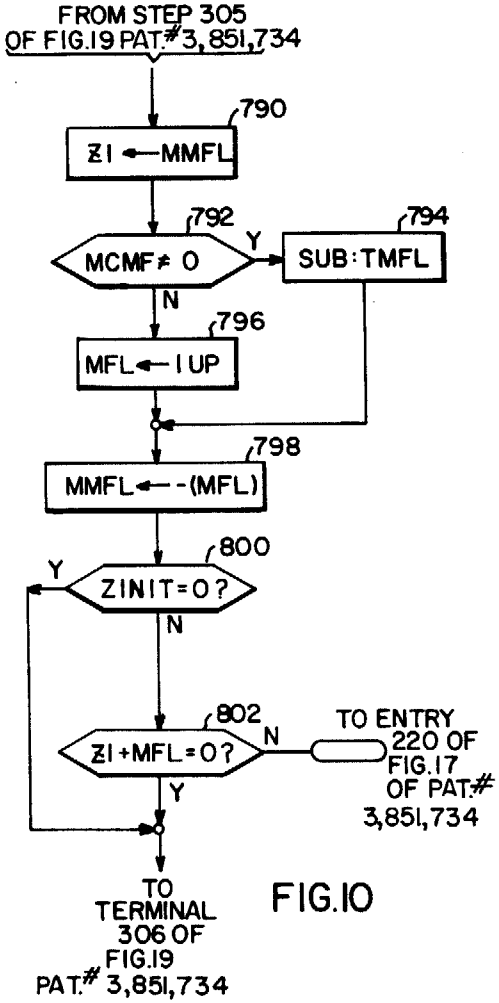
FIG. 10 is a flow chart illustrating an initialization procedure which may be used prior to checking the status of the elevator cars, to determine if the lobby functions should be changed to another floor, and whether or not the lobby functions are associated with the same floor on this run through the car status program, as on the last run.

FIG. 10 is a flow chart which is added between step 305 and terminal 306 of FIG. 19 of the incorporated Sackin patent. FIG. 19 is a flow chart of the status update program CSU, with FIG. 10 being added to program CSU at a point prior to the per car analysis.

After step 305 of the incorporated Sackin patent forms images of the input, output and extra words for the first car to be considered, step 790 sets the variable Z1 to the number of the floor which the program presently considers to be the main or lobby floor, and adds a minus sign in front of this number. Step 792 determines if the master flag for changing the lobby floor, i.e., flag MCMF is set, by checking bit 0 of register CMFR in FIG. 6. If the master flag MCMF is set, step 794 enters the subroutine TMFL, which will determine which of the several different functions requested that the lobby floor be changed, and it will change the lobby functions to another floor if the requested change has a higher priority than the floor presently considered as the lobby floor. If flag MCMF is not set, step 796 sets the main or lobby floor to the normal lobby, such as to floor 1, with the dispatching direction being set at up.

Steps 794 and 796 both proceed to step 798 which sets MMFL to the main floor resulting from steps 794 or 796, with a minus sign in front of the number, which number will be used in step 790 the next time program CSU runs.

Step 800 checks indicator ZINIT to determine if this is the first run through program CSU following start up of the system. If it is the first run ZINIT will be zero, the desired lobby or main floor will be the one set in steps 794 or 796, and the program advances to terminal 306 of FIG. 19 of the Sackin patent. If it is not the first runing of CSU following start up, ZINIT will be non-zero and step 800 advances to step 802 to determine if the lobby floor set by steps 794 or 796 is different than the lobby floor during the previous running of program CSU. This is determined by adding the number of the present main or lobby floor MFL to Z1. The variable Z1 was set to minus the number of main floor used during the last run through subprogram CSU. If the result is zero, the requested main or lobby floor is still the same as the lobby floor on the last run through program CSU, and the program advances to terminal 306. If the result is not zero, the program proceeds to entry 220 of FIG. 17 of the incorporated Sackin patent to reinitialize the system.

FIG. 11

Figure 11:
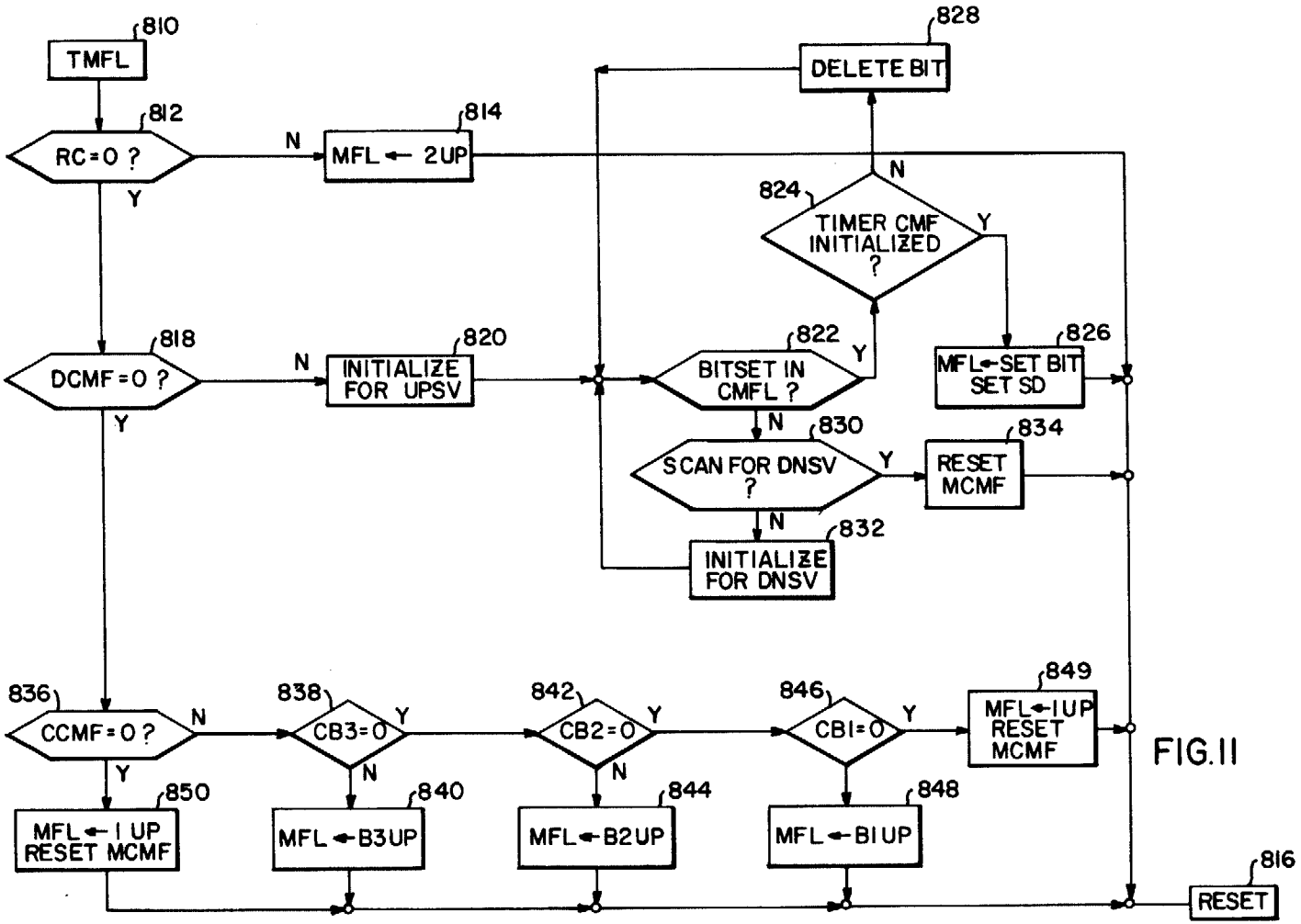
FIG. 11 is a flow chart of a subroutine which may be used along with the flow chart shown in FIG. 10, which subroutine switches lobby functions to a floor selected on the basis of an event indicating that the lobby function should be changed.

FIG. 11 is a flow chart of a subroutine which may be used for the subroutine referred to in FIG. 10 at step 794. Subroutine TMFL starts at input terminal 810 and advances to step 812. Step 812 checks bit 1 of register CMFR in FIG. 6 to determine if the riot control flag RC is set. If bit 1 is non-zero the program advances to step 814 at which point the main floor is set to a predetermined floor, such as to the second floor, with the dispatching direction being upwardly The program then exits the subroutine TMFL at terminal 816, and returns to the main program. If step 812 found that bit 1 of register CMFR was zero, the program advances to step 818 which checks bit 2 of register CMFR, to see if the flag DCMF has been set. If the bit is not zero the program advances to step 820 to initialize for scanning words CMFL0-CMFL2 of Table CMFL, shown in FIG. 5. Once the starting address of word CMFL0 is located, the bits are scanned in the direction of the arrow 740 shown in FIG. 5, to determine if a bit has been set in any of these three words. If a set bit is found, the program advances to step 824 which checks to see if timer CMF in word PNMF (FIG. 4) has been initialized. If it has been initialized the program advances to step 826 which sets the main or lobby floor to the floor number associated with the set bit, and the service direction for dispatching cars from this floor is set. The subroutine then exits from terminal 816 and returns to the main program. If a bit was found set in step 822 and step 824 found that timer CMF was not initialized, in other words it is timed out, the program advances to step 828 which deletes or resets the set bit, by resetting it to zero. The program then goes back to step 822 which continues checking CMFL for a set bit in the three words CMFL0-CMFL2. If step 822 finds no bits set in words CMFL0-CMFL2, the program advances to step 830, which checks to see if Table CMFL has been scanned for down service. Since at this point, the Table CMFL has not been scanned for down service, the program advances to step 832 which sets up the address necessary for scanning the words CMFL3-CMFL5. The program then goes back to step 822 which checks for bits set in words CMFL3-CMFL5. If no bits are found set during the scan for down service the program returns to step 830 which determines that both the up service and down service portions of Table CMFL have been scanned, without finding a bit, and step 834 resets the flag MCMF in register CMFR. If the flag MCMF had been set by the hardware circuit shown in FIG. 2, it will be immediately set again, since the flag signal from the hardware persists as long as the demand to change floors remains. If the flag MCMF had been set by the software in response to a traffic demand condition, step 834 will be successful in resetting the flag to zero. If a bit had been found set when scanning CMFL for down service, step 824 would check to see if the timer had been initialized, and if it hadn't the set bit would be reset to zero by step 828. If the set bit had the associated timer CMF initialized, step 826 would set the main floor to the number associated with the set bit, and it would set the dispatching service direction to down.

If steps 812 and 818 determine that bits 1 and 2 of register CMFR are zero, the program would advance to step 836, which checks bit 3 of register CMFR to see if the flag responsive to clock requested changes of the lobby floor has been set. If flag CMFR is not zero, the program advances to step 838 which checks to see if the hardware signal CB3 is equal to zero. If the signal CB3 is a logic one it indicates that the main floor should be changed to level B3 with an up dispatching direction, which is accomplished in step 840, and the program returns to the main program via the terminal 816.

If signal CB3 is equal to zero, step 842 determines if signal CB2 is zero. If it is not zero, step 844 sets the main floor to floor B2 with an up dispatching direction and the program returns via 816 to the regular program. If signal CB2 is zero, the program advances to step 846 and checks signal CB1. If signal CB1 is at the logic one level, step 848 sets the main floor to level B1 with an up dispatching direction, and returns to the main program via terminal 816. If step 846 finds that signal CB1 is a zero, step 849 sets the main floor to one with an up dispatching direction, and it resets flag MCMF.

If step 836 found that flag CCMF was zero, step 850 sets the main floor to the normal main floor with an up dispatching direction, and resets the master flag MCMF. The program then advances to terminal 816 where it returns to the regular program.

FIG. 12

When the main or lobby floor functions are moved to a floor above the normal main floor, and the dispatching direction is upwardly, all of the floors below the main floor may be considered as basement floors and they may be handled with the normal basement strategy. When the dispatching direction is downwardly from any floor selected as the lobby floor, the floor calls from floors located above this lobby floor will not be served without a modification to FIGS. 20A and 22A of the incorporated Sackin patent to recognize this situation and to dispatch cars to serve these calls. A special zone LTX is set up for the floors above the main floor when the dispatching direction is downwardly from the main floor.

Figures 12, 13:
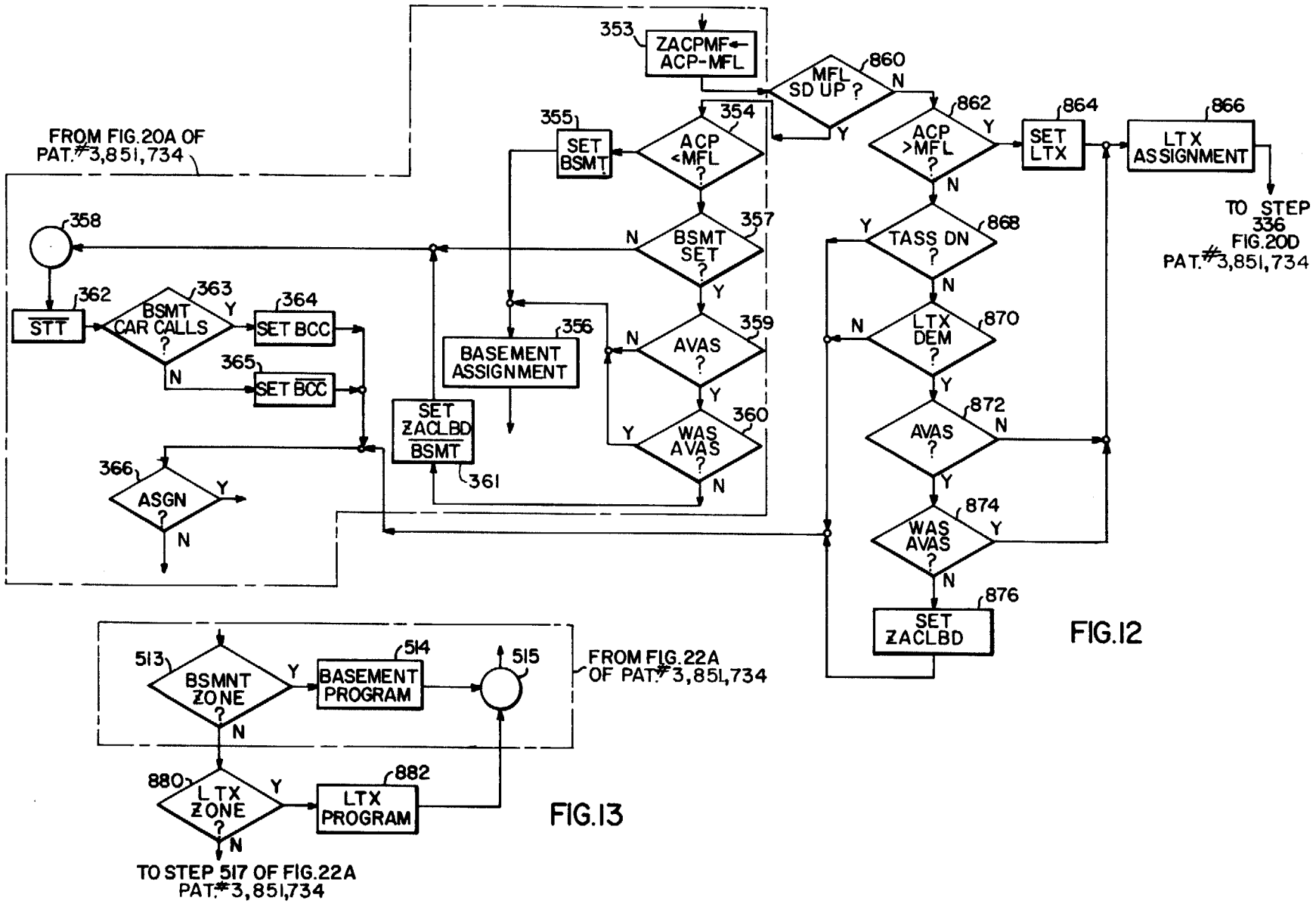
FIG. 12 is a flow chart which indicates an arrangement for providing elevator service for floors located above the lobby floor, when the dispatching direction from the lobby floor is down.
FIG. 13 is a flow chart which indicates an arrangement for handling the floors located above the lobby floor, when the dispatching direction from the lobby floor is down.

Subprogram CSU shown in FIG. 20A of the incorporated Sackin patent may be modified as illustrated in FIG. 12. Following step 353 of the Sackin patent, step 860 is added to check the dispatching direction from the main floor. If the dispatching direction is upwardly, the program advances to step 354, and the program is the same as described in the Sackin patent. If step 860 determines that the dispatching direction is down, any suitable strategy may be used to handle the floor calls located in the floors above the main floor. For example, a program which may be used may include the step of determining if the advanced car position of the car being considered is greater than the main floor. This is accomplished in step 862. If the advanced car position is greater than the main floor it indicates that the advanced car position is above the main floor and step 864 sets the zone of the car to LTX, and the program advances to the LTX assignment in step 866. A suitable assignment might simply be to remove the car from control by the system processor, which enables it to see all calls ahead of its travel direction, and when there are no further calls ahead of its travel direction it will reverse and answer calls for service in the opposite direction. Once it returns to the main floor, it will again come under control of the system processor. Following the LTX assignment in step 866, the program advances to step 336 of FIG. 20D of the Sackin patent.

If step 862 determines that the advanced car position is below the main floor, step 868 determines the travel assignment direction of the car. If the assignment direction is down, the program advances to step 366 in FIG. 20A of the Sackin patent. If step 868 determines that the travel assignment is up, step 870 determines if there is a demand for service from the floors located above the main floor. A demand for LTX is determined by subprogram ACL when the dispatching direction is down and subprogram ACL cannot allocate a call from zone LTX to a busy elevator car. If step 870 determines there is no LTX demand, the program advances to step 366. If step 870 determines there is an LTX demand, the program advances to step 872 to determine if the elevator car is available according to the floor selector (AVAS=1). If it is not available, it is a busy car, and may be assigned to the demand located in the floors above the main floor and the program advances to the LTX assignment in step 866. If step 872 determines that the elevator car is available according to the floor selector the program advances to step 874 to determine if the elevator car was available on the previous running of the program. If it is now available and it was available on the previous running of the program, the car may be assigned to the demand located in the floors above the main floor, and the program proceeds to step 866. If the car is now available, but it was not available on the previous running of the program, this is a condition which should be considered in the processing of all of the calls, and step 876 sets flag ZACLBD, which, when set, indicates that all of the floor calls in the call table CL should be reprocessed since there is a newly available car in the system. The program advances from step 876 to step 366.

FIG. 13

FIG. 13 is a flow chart which illustrates how subprogram ACL illustrated in FIG. 22A of the incorporated Sackin patent may be modified. When step 513 in the incorporated Sackin patent determines that the call is not for the basement zone, step 880 determines if the call is from the LTX zone, i.e., from a floor located above the main floor when the dispatching direction from the main or lobby floor is down. If the call is from the LTX zone, the program advances to the LTX program 882, which may select a car for this call based upon any suitable strategy. The program then advances to terminal 515 of the Sackin patent. If step 880 determines that the call in question is not from the LTX zone, the program advances to step 517 of the Sackin patent.

If the LTX program of step 882 fails to allocate the LTX call to a suitable busy car, step 882 sets a predetermined bit in the demand indicator word DEMIND. Subprogram ACR shown in FIGS. 23A and 23B of the incorporated Sackin patent would be modified to add a step to check this bit of DEMIND when the dispatching direction is down. Upon finding an LTX demand subprogram ACR would enter steps for assigning an available car to the demand.

In summary, there has been disclosed a new and improved elevator system, and method of operating same, which enables any floor of a building to be a utilized as the main or lobby floor, with dispatching from the floor in either the up or down directions. This is accomplished without special hardware for any of the floors, by identifying the main floor only in the instructions or software of a programable system processor which controls the operation of the various elevator cars to service the floors of the building. The main or lobby floor is initially set to the normal lobby with an upward dispatching direction, and anticipated traffic, actual traffic, or a deliberate switch to another floor by operating an appropriate switch, may all be utilized singly or in any combination to determine when the lobby floor function should be changed to a different floor, in order to accommodate the traffic conditions, or to implement certain strategy such as riot control strategy.

We claim as our invention:

1. In an elevator system, a method of providing predetermined lobby functions at a selectable floor of a building, comprising the steps of:
   - providing a plurality of elevator cars,
   - providing status signals responsive to said elevator cars,
   - providing means for registering requests for elevator service,
   - providing a system processor including a memory responsive to the status signals and requests for elevator service for providing signals for controlling movement of the elevator cars,
   - providing software instructions for the memory which select a floor of the building as a special floor,
   - detecting the desirability of switching the selected special floor to a different floor,
   - and changing the specified special floor in the software instructions to a different floor responsive to the detecting step.

2. The method of claim 1 wherein the step of detecting the desirability of switching the selected special floor to a different floor is responsive to an actual traffic condition.

3. The method of claim 1 wherein the step of detecting the desirability of switching the selected special floor to a different floor includes the step of determining the traffic demand level at certain of the floors.

4. The method of claim 1 wherein the step of detecting the desirability of switching the selected special floor to a different floor includes the step of determining the demand for elevator service at certain of the floors and the service direction of the demand.

5. The method of claim 1 wherein the special floor specified in the step of providing software instructions for the memory is the normal lobby floor, and including the step of changing the specified special floor back to the normal lobby floor when the normal lobby floor has been changed to a different floor responsive to the detecting step, and the detecting step no longer detects the desirability for such a change.

6. In an elevator system, a method of providing predetermined lobby functions at a selectable floor of a building, comprising the steps of:

providing wired control means for each floor of the building, with all of the wired control means being similar in their lack of wired control for providing lobby functions, providing a plurality of elevator cars, providing status signals responsive to said elevator cars, providing means for registering requests for elevator service, providing a system processor including a memory responsive to the status signals and requests for elevator service for providing signals for controlling movement of the elevator cars, providing instructions for the memory which direct the elevator cars to provide predetermined lobby functions for a floor specified in the instructions, detecting the desirability of switching the lobby floor functions to a different floor, and changing the specified lobby floor in the instructions to a different floor responsive to the detecting step.

7. In an elevator system, a method of providing predetermined lobby functions at a selectable floor of a building, comprising the steps of:

providing a plurality of elevator cars, providing status signals responsive to said elevator cars, providing means for registering requests for elevator service, providing a system processor including a memory responsive to the status signals and requests for elevator service for providing signals for controlling movement of the elevator cars, providing instructions for the memory which direct the elevator cars to provide predetermined lobby functions for a floor specified in the instructions, detecting the desirability of switching the lobby floor functions to a different floor, with the step of detecting the desirability of switching the lobby floor functions to a different floor including the step of anticipating a peak traffic condition at a floor, and changing the specified lobby floor in the instructions to a different floor responsive to the detecting step.

8. The method of claim 7 including the step of providing timing means synchronized with anticipated traffic conditions, and wherein the step of anticipating traffic conditions is responsive to the timing means.

9. In an elevator system, a method of providing predetermined lobby functions at a selectable floor of a building, comprising the steps of:

providing a plurality of elevator cars, providing status signals responsive to said elevator cars, providing means for registering requests for elevator service, providing a system processor including a memory responsive to the status signals and requests for elevator service for providing signals for controlling movement of the elevator cars, providing instructions for the memory which direct the elevator cars to provide predetermined lobby functions for a floor specified in the instructions, providing switching means operable between first and second conditions, detecting the desirability of switching the lobby floor functions to a different floor, with the step of detecting the desirability of switching the lobby floor functions to another floor being responsive to the condition of the switching means, and changing the specified lobby floor in the instructions to a different floor responsive to the detecting step, with the step of changing the specified lobby floor occurring when the switching means is in its second condition.

10. The method of claim 9 including the step of inhibiting cars from providing elevator service to at least one of the floors when the switching means is in its second condition.

11. In an elevator system, a method of providing predetermined lobby functions at a selectable floor of a building, comprising the steps of:

providing a plurality of elevator cars, providing status signals responsive to said elevator cars, providing means for registering requests for elevator service, providing a system processor including a memory responsive to the status signals and requests for elevator service for providing signals for controlling movement of the elevator cars, providing instructions for the memory which direct the elevator cars to provide predetermined lobby functions for a floor specified in the instructions, detecting the desirability of switching the lobby floor functions to a different floor, with the step of detecting the desirability of switching the lobby floor functions to a different floor including the step of determining the demand for elevator service at certain of the floors and the service direction of the demand, changing the specified lobby floor in the instructions to a different floor responsive to the detecting step, and dispatching elevator cars from the floor specified in the instructions, with the dispatching direction being the service direction of the demand when the specified lobby floor has been selected in response to traffic demand at the floor.

12. An elevator system, comprising:

a building having a plurality of floors, a plurality of elevator cars mounted for movement in the building to service the floors, means providing status signals responsive to said plurality of elevator cars, means for registering requests for elevator service, system processor means including memory means having software instructions stored therein, said system processor means providing signals for directing the movement of said elevator cars responsive to said requests for elevator service and said status signals, said memory means including software instructions which select a floor of the building as a special floor, detector means detecting the desirability of switching the selected special floor to a floor other than the floor presently specified in the software instructions, and means changing the selected special floor specified in the software instructions responsive to said detector means.

13. The elevator system of claim 12 wherein the detector means includes traffic responsive means responsive to a predetermined traffic condition at certain of the floors, with the detector means indicating the desirability of changing the specified special floor to a different floor in response to said traffic responsive means.

14. The elevator system of claim 12 including means changing the specified special floor back to the originally identified floor when the detector means no longer detects the desirability of switching the special floor to a different floor.

15. An elevator system, comprising:

a building having a plurality of floors, wired control means for each floor of the building, said wired control means all being similar in the lack of wired control for providing lobby functions, a plurality of elevator cars mounted for movement in the building to service the floors, means providing status signals responsive to said plurality of elevator cars, means for registering requests for elevator service, system processor means including memory means having instructions stored therein, said system processor means providing signals for directing the movement of said elevator cars responsive to said requests for elevator service and said status signals, said memory means including instructions which provide predetermined lobby functions for a floor of the building identified in the instructions, detector means detecting the desirability of providing the predetermined lobby functions of a floor other than the floor presently specified in the instructions, and means changing the floor specified in the instructions responsive to said detector means.

16. An elevator system, comprising:

a building having a plurality of floors, a plurality of elevator cars mounted for movement in the building to service the floors, means providing status signals responsive to said plurality of elevator cars, means for registering requests for elevator service, system processor means incluing memory means having instructions stored therein, said system processor means providing signals for directing the movement of said elevator cars responsive to said requests for elevator service and said status signals, said memory means including instructions which provide predetermined lobby functions for a floor of the building identified in the instructions, detector means detecting the desirability of providing the predetermined lobby functions for a floor other than the floor presently specified in the instructions, with the detector means including timing means operable from a first condition to a second condition at a predetermined time when peak traffic conditions are expected at a predetermined floor, and means changing the floor specified in the instructions responsive to said detector means, with the means changing the floor specified in the instructions being responsive to said timing means.

17. An elevator system, comprising:

a building having a plurality of floors, a plurality of elevator cars mounted for movement in the building to service the floors, means providing status signals responsive to said plurality of elevator cars, means for registering requests for elevator service, system processor means including memory means having instructions stored therein, said system processor means providing signals for directing the movement of said elevator cars responsive to said requests for elevator service and said status signals, said memory means including instructions which provide predetermined lobby functions for a floor of the building identified in the instructions, detector means detecting the desirability of providing the predetermined lobby functions for a floor other than the floor presently specified in the instructions, with the detector means including switching means operable between first and second conditions, and means changing the floor specified in the instructions responsive to said detector means, with the means changing the floor specified in the instructions being responsive to said switching mens, changing the specified floor to a predetermined floor when the switching means is in its second condition.

18. The elevator system of claim 17 including means inhibiting the plurality of elevator cars from providing service to at least one of the floors when the switching means is in its second condition.

19. The elevator system of claim 17 including means inhibiting the plurality of elevator cars from providing service to at least one of the floors when the switching means is in its second condition, and wherein the detector means includes traffic responsive means responsive to a predetermined traffic condition at certain of the floors, with the detector means indicating the desirability of providing predetermined lobby functions at a different floor in response to said traffic responsive means, said traffic responsive means including means identifying the service direction of the traffic.

20. The elevator system of claim 19 including means setting the dispatching direction from the special floor to the identified service direction of the traffic.

* * * * *